US011864679B1

(12) United States Patent
Holtschlag

(10) Patent No.: US 11,864,679 B1
(45) Date of Patent: Jan. 9, 2024

(54) DISPLAY CLIPS

(71) Applicant: D Squared Plant Traps LLC, Pittsburgh, PA (US)

(72) Inventor: Deborah Holtschlag, Pittsburgh, PA (US)

(73) Assignee: D Squared Plant Traps LLC, Pittsburgh, PA (US)

( * ) Notice: Subject to any disclaimer, the term of this patent is extended or adjusted under 35 U.S.C. 154(b) by 0 days.

(21) Appl. No.: 18/369,166

(22) Filed: Sep. 16, 2023

Related U.S. Application Data

(60) Provisional application No. 63/450,605, filed on Mar. 7, 2023, provisional application No. 63/407,538, filed on Sep. 16, 2022.

(51) Int. Cl.
*A47G 7/04* (2006.01)

(52) U.S. Cl.
CPC ..... *A47G 7/044* (2013.01)

(58) Field of Classification Search
CPC ..... A47G 7/044
See application file for complete search history.

(56) References Cited

U.S. PATENT DOCUMENTS

| | | | | |
|---|---|---|---|---|
| D28,589 | S | 5/1898 | Wedmore | |
| 1,220,717 | A * | 3/1917 | Bennett | A47G 29/083 211/35 |
| 1,913,587 | A * | 6/1933 | Edwards | A47G 29/14 248/311.2 |
| 1,930,673 | A | 10/1933 | Consolazio | |
| 2,747,825 | A | 6/1952 | Lachenmayer | |
| 3,414,311 | A | 12/1968 | Trimboli | |
| 3,502,294 | A | 3/1970 | Kalbow et al. | |
| 3,516,801 | A | 6/1970 | Shah | |
| D231,296 | S * | 4/1974 | Morris | D6/556 |
| D242,314 | S | 11/1976 | Arnett | |

(Continued)

FOREIGN PATENT DOCUMENTS

| | | |
|---|---|---|
| CH | 621935 | 3/1981 |
| DE | 924284 | 2/1955 |

(Continued)

OTHER PUBLICATIONS

Plant traps website, Railscapes Vertical Garden Clip, Apr. 2, 2023, https://www.planttraps.com/products/railscaping-clip (Year: 2023).

*Primary Examiner* — Monica L Perry
(74) *Attorney, Agent, or Firm* — Alan G. Towner; Leech Tishman Fuscaldo & Lampl

(57) ABSTRACT

Display clips are disclosed that may include a front plant-receiving upper hoop and a lower support base for supporting the plant or other article. The display clips also include a rear railing support bracket with opposing spring clamps that allow the display clips to be removably mounted on railings between adjacent spindles. For installation, opposed vertical arms of the rear railing support bracket may be drawn together to elastically deform the display clip to allow the rear bracket to fit between the adjacent spindles. Once between the spindles, the opposed spring clamps can be released to spring back to engage the spindles in order to secure the bracket on the railing. The rear spring clamps may have resilient bumpers mounted thereon to cushion and help hold the display clip on the railing spindles.

30 Claims, 22 Drawing Sheets

(56) References Cited

U.S. PATENT DOCUMENTS

| | | | | |
|---|---|---|---|---|
| D251,579 | S | 4/1979 | Calgaro | |
| D262,678 | S | 1/1982 | DeBoer | |
| D266,382 | S | 10/1982 | Hutchinson | |
| D285,510 | S | 9/1986 | Douglas et al. | |
| 4,623,113 | A | 11/1986 | Studebaker | |
| 4,882,875 | A | 11/1989 | Green | |
| D316,058 | S | 4/1991 | Mitchell et al. | |
| 5,127,188 | A | 7/1992 | Shaw et al. | |
| D332,212 | S | 1/1993 | Mitchell et al. | |
| D337,938 | S | 8/1993 | Shaw et al. | |
| D338,122 | S | 8/1993 | Emalfarb et al. | |
| 5,269,095 | A | 12/1993 | Helfman et al. | |
| D344,876 | S | 3/1994 | Vandergon | |
| 5,320,319 | A | 6/1994 | Winger et al. | |
| D350,081 | S | 8/1994 | May | |
| 5,368,267 | A | 11/1994 | Howard | |
| 5,390,443 | A | 2/1995 | Emalfarb et al. | |
| 5,405,116 | A | 4/1995 | Shepherd et al. | |
| 5,577,699 | A * | 11/1996 | Gardner | A47F 5/08 248/302 |
| D383,916 | S | 9/1997 | Richards et al. | |
| 5,711,433 | A | 1/1998 | Smith | |
| D393,159 | S | 4/1998 | Richards et al. | |
| D406,978 | S | 3/1999 | Cox | |
| D409,854 | S | 5/1999 | Rehmert et al. | |
| D415,366 | S | 10/1999 | Walters-Dowding et al. | |
| D419,812 | S | 2/2000 | Robichaud | |
| 6,050,532 | A | 4/2000 | Paul | |
| D425,326 | S | 5/2000 | Rehmert et al. | |
| 6,079,686 | A | 6/2000 | Reed | |
| D428,848 | S | 8/2000 | Wurst | |
| D433,958 | S | 11/2000 | Rosenberg | |
| D554,927 | S | 11/2007 | Smith | |
| D555,462 | S * | 11/2007 | Moffitt | D8/370 |
| D573,011 | S | 7/2008 | Decker et al. | |
| D628,835 | S | 12/2010 | Valentine, Jr. | |
| D660,102 | S | 5/2012 | Allred | |
| D678,043 | S | 3/2013 | Lu | |
| 8,561,345 | B2 | 10/2013 | Armas | |
| 8,596,473 | B2 | 12/2013 | Newbould et al. | |
| 8,979,043 | B2 | 3/2015 | Florman | |
| D885,082 | S | 5/2020 | Frohlich | |
| D916,511 | S | 4/2021 | Padgett | |
| 2005/0167551 | A1* | 8/2005 | Leroux | B65F 1/141 248/153 |
| 2009/0224118 | A1* | 9/2009 | Meyers | A47G 29/08 248/215 |
| 2011/0303809 | A1* | 12/2011 | Tincher | A47G 23/0225 248/214 |
| 2013/0264443 | A1* | 10/2013 | Armas | A47G 7/044 248/219.4 |
| 2022/0087450 | A1 | 3/2022 | Holtschlag | |

FOREIGN PATENT DOCUMENTS

| | | |
|---|---|---|
| DE | 19643941 | 5/1998 |
| DE | 29821437 | 4/2000 |
| DE | 20014817 | 1/2002 |
| EP | 1025781 | 8/2000 |
| EP | 2014204 | 1/2009 |
| FR | 2520218 | 7/1983 |
| FR | 2617030 | 12/1988 |
| FR | 2859091 | 3/2005 |

* cited by examiner

DISPLAY CLIPS

CROSS-REFERENCE TO RELATED APPLICATIONS

This application claims the benefit of U.S. Provisional Patent Application No. 63/407,538 filed Sep. 16, 2022, and U.S. Provisional Patent Application No. 63/450,605 filed Mar. 7, 2023, both of which are incorporated herein by reference.

FIELD OF THE INVENTION

The present invention relates to display clips that may be used to support and display plants and other articles on various types of railings.

BACKGROUND INFORMATION

There are many devices for displaying plants on balconies and deck railings. Traditionally, plants are often displayed on the top railing.

SUMMARY OF THE INVENTION

Display clips are provided that may include a front plant-receiving upper hoop and a lower support base for supporting the plant or other article. The display clips also include a rear railing support bracket with opposing spring clamps that allow the display clips to be removably mounted on railings between adjacent spindles. For installation, opposed vertical arms of the rear railing support bracket may be drawn together to elastically deform the display clip to allow the rear bracket to fit between the adjacent spindles. Once between the spindles, the opposed spring clamps can be released to spring back to engage the spindles in order to secure the bracket on the railing. The rear spring clamps may have resilient bumpers mounted thereon to cushion and help hold the display clip on the railing spindles.

An aspect of the present invention is to provide a display clip for mounting on railings. The display clip includes an upper hoop, a lower support base, and opposing spring clamps extending between the upper hoop and lower support base. The opposing spring clamps may include a first upper clamp recess adjacent the upper hoop, a first lower clamp recess adjacent the lower support base, and a first rear connecting arm extending between the first upper clamp recess and the first lower clamp recess. The first upper clamp recess and the first lower clamp recess are structured and arranged to engage a first railing spindle when the display clip is mounted on a railing. The opposing spring clamps may also include a second upper clamp recess adjacent the upper hoop, a second lower clamp recess adjacent the lower support base, and a second rear connecting arm extending between the second upper clamp recess and the second lower clamp recess. The second upper clamp recess and the second lower clamp recess are structured and arranged to engage a second railing spindle when the display clip is mounted on the railing.

Another aspect of the present invention is to provide a display clip and mounting bumper kit that includes a display clip as described above and at least one resilient bumper tube structured and arranged for mounting on at least one of the first upper clamp recess, second upper clamp recess, first lower clamp recess and second lower clamp recess. The kit may also include a packaging pocket removably attached to the display clip that contains the bumper tube.

A further aspect of the present invention is to provide a method of mounting a display clip as described above on railing spindles. The method includes flexing the opposing clamps of the display clip to a flexed position allowing the opposing clamps to pass between adjacent railing spindles, and allowing the opposing clamps to spring back against the railing spindles to thereby secure the display clip on the railing spindles.

These and other aspects of the present invention will be more apparent from the following description.

DETAILED DESCRIPTION

Figure 1:
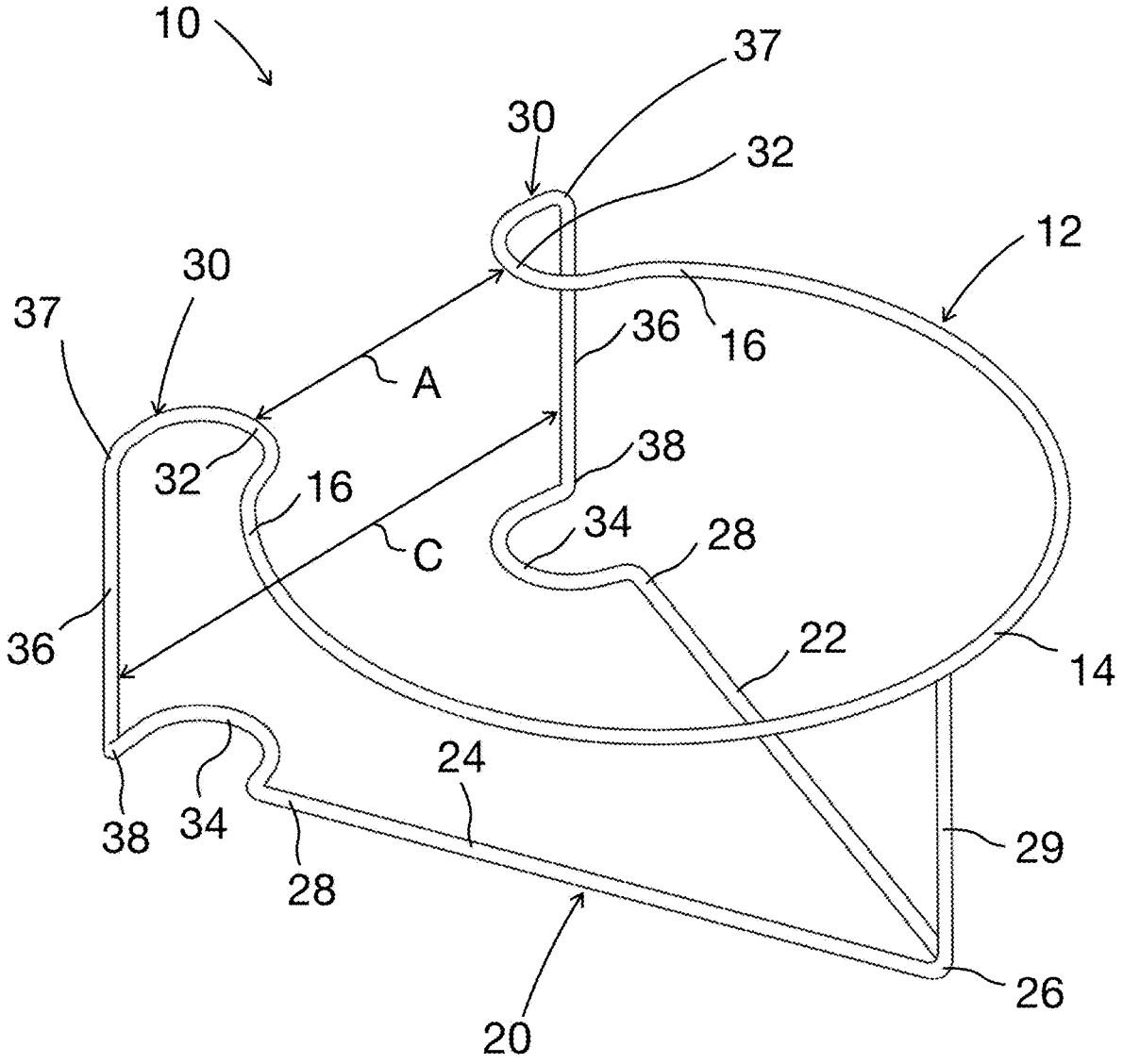
FIG. 1 is a top front isometric view of a display clip that may be used to support and display plants on railings in accordance with an embodiment of the present invention.

FIGS. 1-8 illustrate a display clip 10 that may be used to support and display plants or other articles on railings or similar structures in accordance with an embodiment of the present invention. The display clip 10 includes an upper hoop 12, lower support base 20, and opposing spring clamps 30. The upper hoop 12 includes a generally circular front portion 14 terminating in rear transition portions 16. In the embodiment shown, the front portion 14 and rear transition portions 16 of the upper hoop 12 lie in an upper plane that is typically horizontal when the display clip 10 is installed on a railing. Although the front portion 14 of the upper hoop 12 is circular in the embodiment shown, any other suitable shape may be used such as ovular, square, rectangular, hexagonal, octagonal, or the like.

The lower support base 20 includes a first support rod 22 and a second support rod 24, which intersect each other at a transition nose 26 near the front of the display clip 10. The first and second support rods 22 and 24 terminate near the rear of the display clip 10 at rear base transition portions 28. In the embodiment shown, the lower support base 20 including the first and second support rods 22 and 24, and transition nose 26, lie in a lower plane that is typically horizontal when the display clip 10 is installed on a railing. Although the first and second support rods 22 and 24 shown in the figures are straight and intersect each other at the transition nose 26 to form a generally triangular shape, any other suitable support rod shapes and lower support base configurations may be used. For example, each of the first and second support rods may be curved to form circular arcs that meet at the front of the support base, e.g., the lower support base may include a generally circular lower hoop of the same shape and diameter as the generally circular upper hoop 12, or a generally circular hoop of smaller diameter than the upper hoop 12. In addition to the generally triangular shape of the support base 20 shown in the figures, or a generally circular lower support base as described above, any other suitable shapes or numbers of base support rods may be used. For example, additional support rod(s) may be connected to and extend radially inward from the front portion of the support base rods described above. Such additional base support rod(s) may be connected at any desired location(s) and may lie in substantially same lower plane as the other support rods of the lower support base 20.

As further shown in FIGS. 1-8, the display clip 10 may include a front connecting arm 29 extending between the upper hoop 12 and the lower support base 20. In the embodiment shown, the front connecting arm extends vertically from the front portion 14 of the upper hoop 12 to the transition nose 26 of the lower support base 20. However, any other suitable number of connecting arms and locations may be provided between the upper hoop 12 and lower support base 20, e.g., zero, two, three, etc. connecting arms. While the front connecting arm 29 shown in the figures is vertical, any other suitable orientation may be used in which the connecting arm(s) extend in a direction having a vertical component, e.g., a straight connecting arm angled radially inward or outward as it extends from the upper hoop 12 to the lower support base 20.

As further shown in FIGS. 1-8, the display clip 10 includes opposing spring clamps 30 that may be used to install the display clip 10 on railing spindles, as more fully described below. As most clearly shown in FIGS. 1, 2, 7 and 8, the rear portion of the display clip 10 includes first and second upper clamp recesses 32 and first and second lower clamp recesses 34 that form first and second clamp channels 35 for receiving railing spindles when the display clip 10 is installed on a railing or similar structure. The spindle-receiving upper clamp channels 35 may be structured and arranged to engage the railing spindles to hold the display clip 10 in a desired position on a railing. In the embodiment shown, the first and second clamp channels 35 have recess openings that face away from each other, and the display clip 10 is installed on railing spindles by pinching the clamp channels 35 together. Alternatively, the first and second clamp channels may have recess openings that face each other, and the display clip is installed on railing spindles by pulling the clamp channels apart.

As shown in FIGS. 1-6, first and second rear connecting arms 36 may extend between the first and second upper clamp recesses 32 and the first and second lower clamp recesses 34, respectively. In the embodiment shown, the rear connecting arms 36 extend vertically between the upper hoop 12 and lower support base 20. However, any other suitable shape and orientation of connecting arms may be used. Upper transitions 37 are provided between the upper clamp recesses 32 and rear connecting arms 36. Lower transitions 38 are provided between the lower clamp recesses 34 and the rear connecting arms 36.

Figure 2:
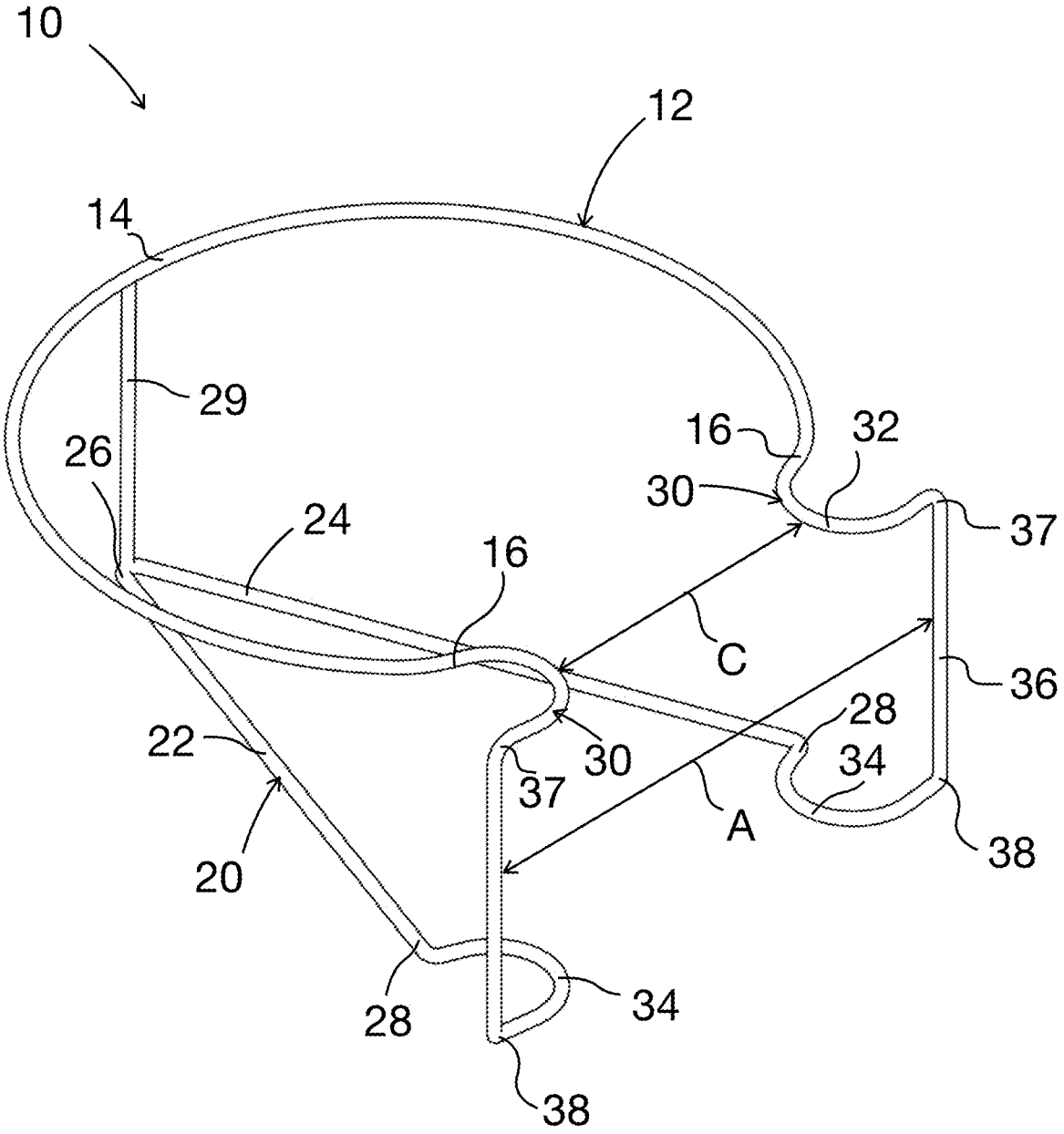
FIG. 2 is a top rear isometric view of the display clip of FIG. 1.
Figure 3:
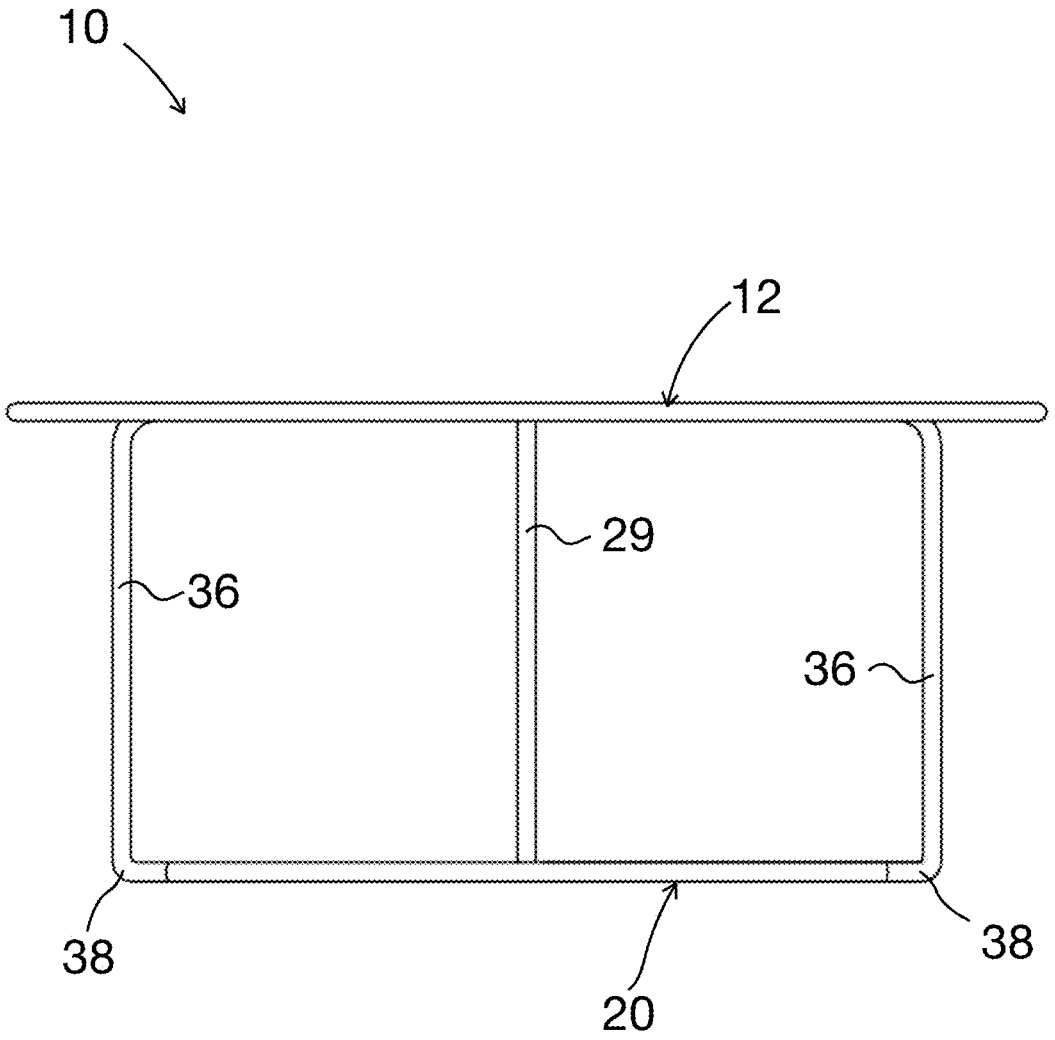
FIG. 3 is a front view of the display clip of FIG. 1.
Figure 4:
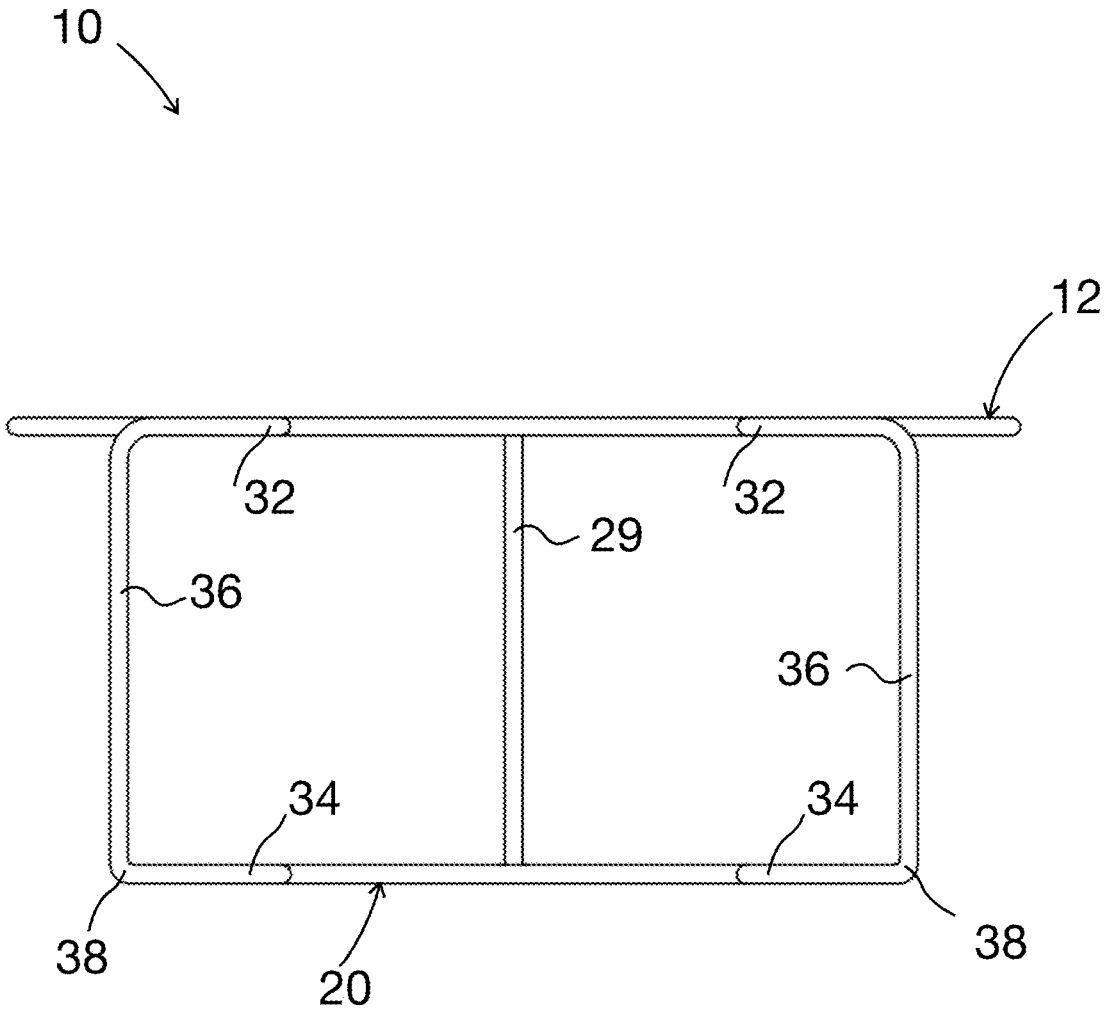
FIG. 4 is a rear view of the display clip of FIG. 1.
Figure 5:
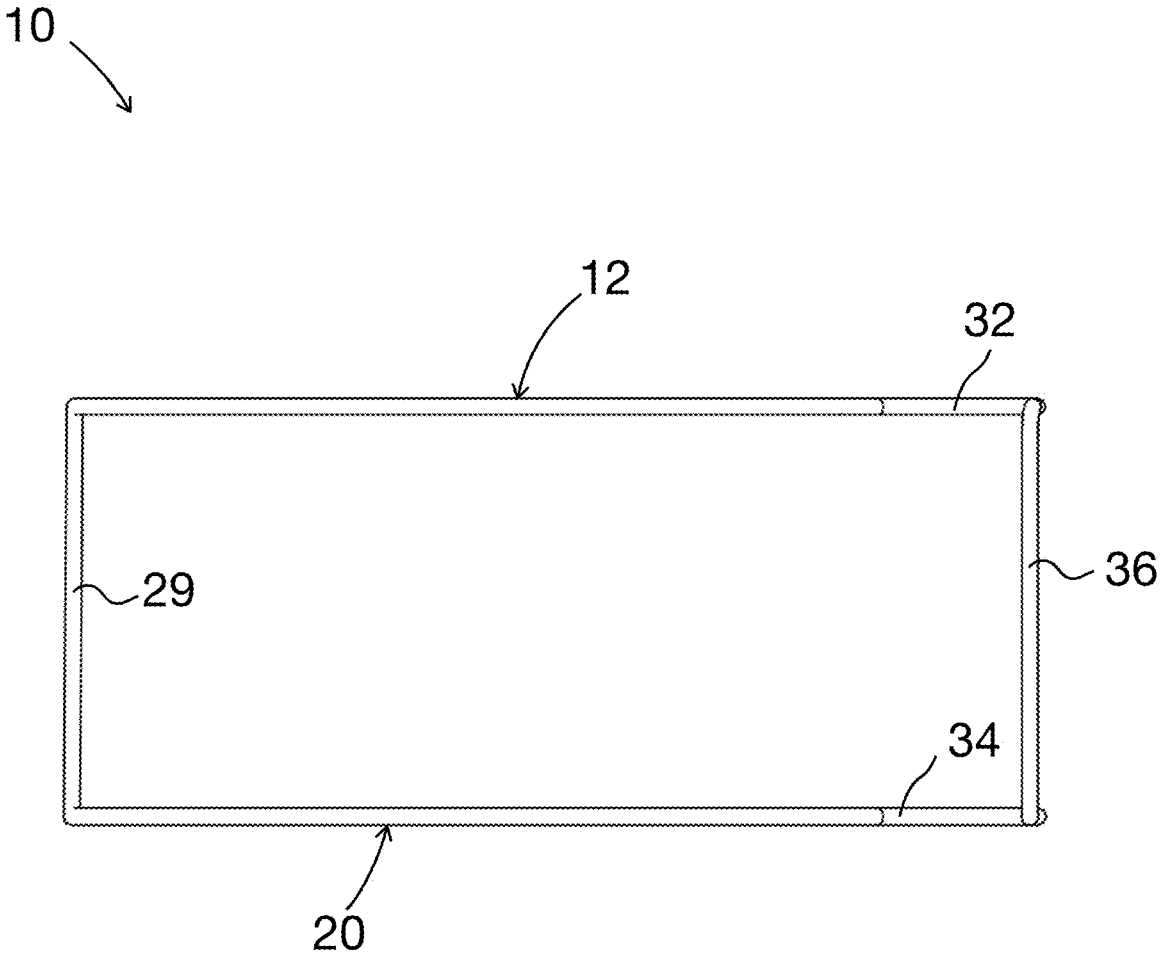
FIG. 5 is a right side view of the display clip of FIG. 1.
Figure 6:
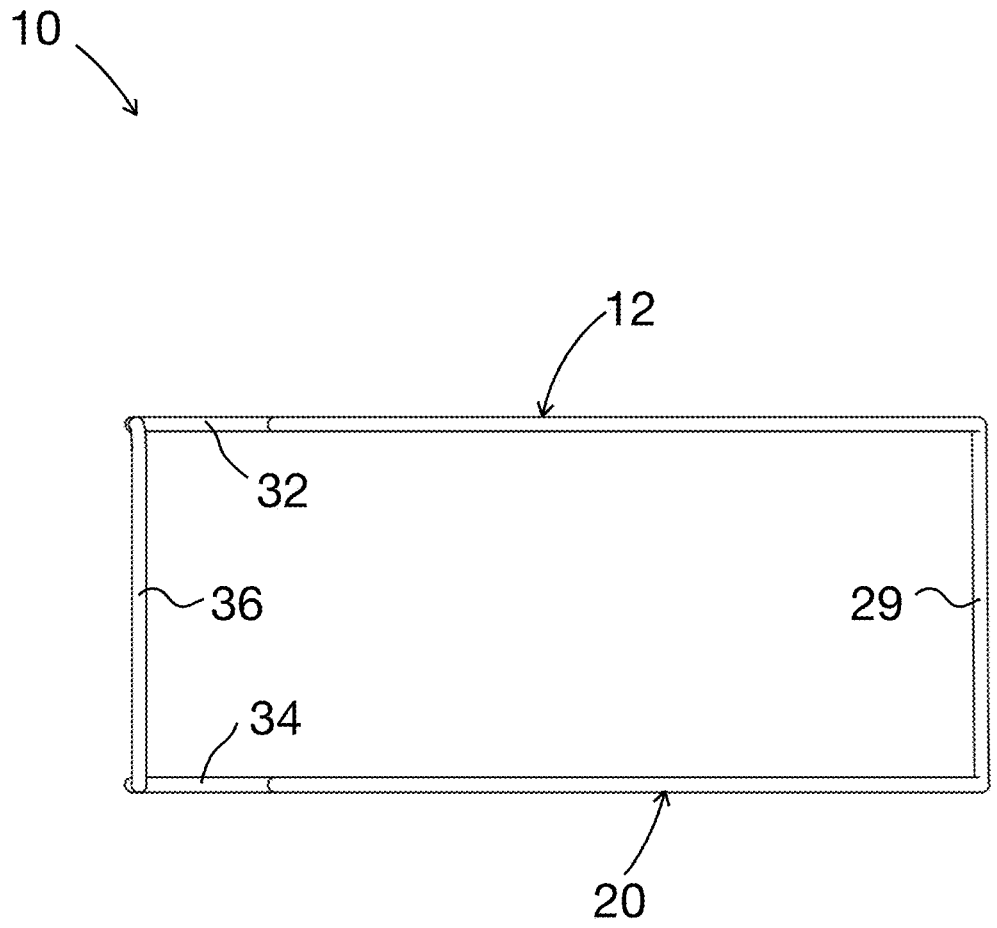
FIG. 6 is a left side view of the display clip of FIG. 1.

As shown most clearly in FIGS. 1 and 2, the upper hoop 12 transitions into the first and second upper clamp recesses 32 at the first and second rear transition portions 16. Similarly, the first and second support rods 22 and 24 of the lower support base 20 transition into the first and second lower clamp recesses 34 at the first and second rear base transition portions 28. As described above, the straight first and second support rods 22 and 24 may be replaced with a continuous circular hoop, in which case the first and second rear base transition portions 28 may transition into the lower base hoop in a similar manner as the upper hoop 12 transitions with the first and second rear transition portions 16.

As shown and labeled in FIGS. 1, 2, 7 and 8, the upper and lower clamp recesses 32 and 34 that form the clamp channels 35 are separated from each other at a clamp separation distance C prior to installation of the display clip 10 on railing spindles or other structures. As further shown, the rear connecting arms 36 are separated from each other at rear arm separation distance A prior to installation. As more fully described below, during installation of the display clip 10, the opposing spring clamps 30 may be forced or flexed toward each other to decrease the clamp separation distance C and rear arm separation distance A to fit the opposing spring clips 30 between adjacent railing spindles in order to mount the display clip 10 on the railing.

Figure 7:
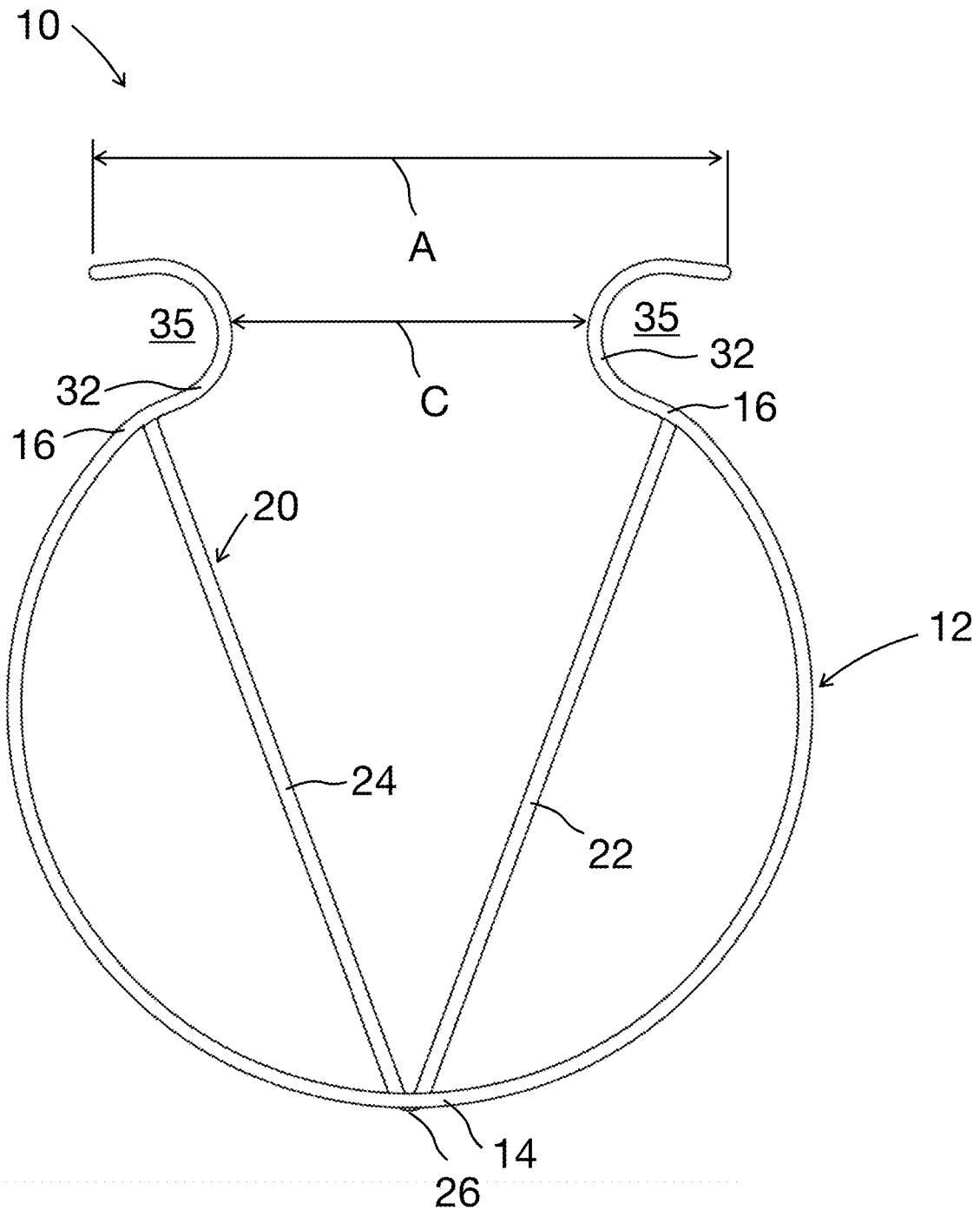
FIG. 7 is a top view of the display clip of FIG. 1.
Figure 8:
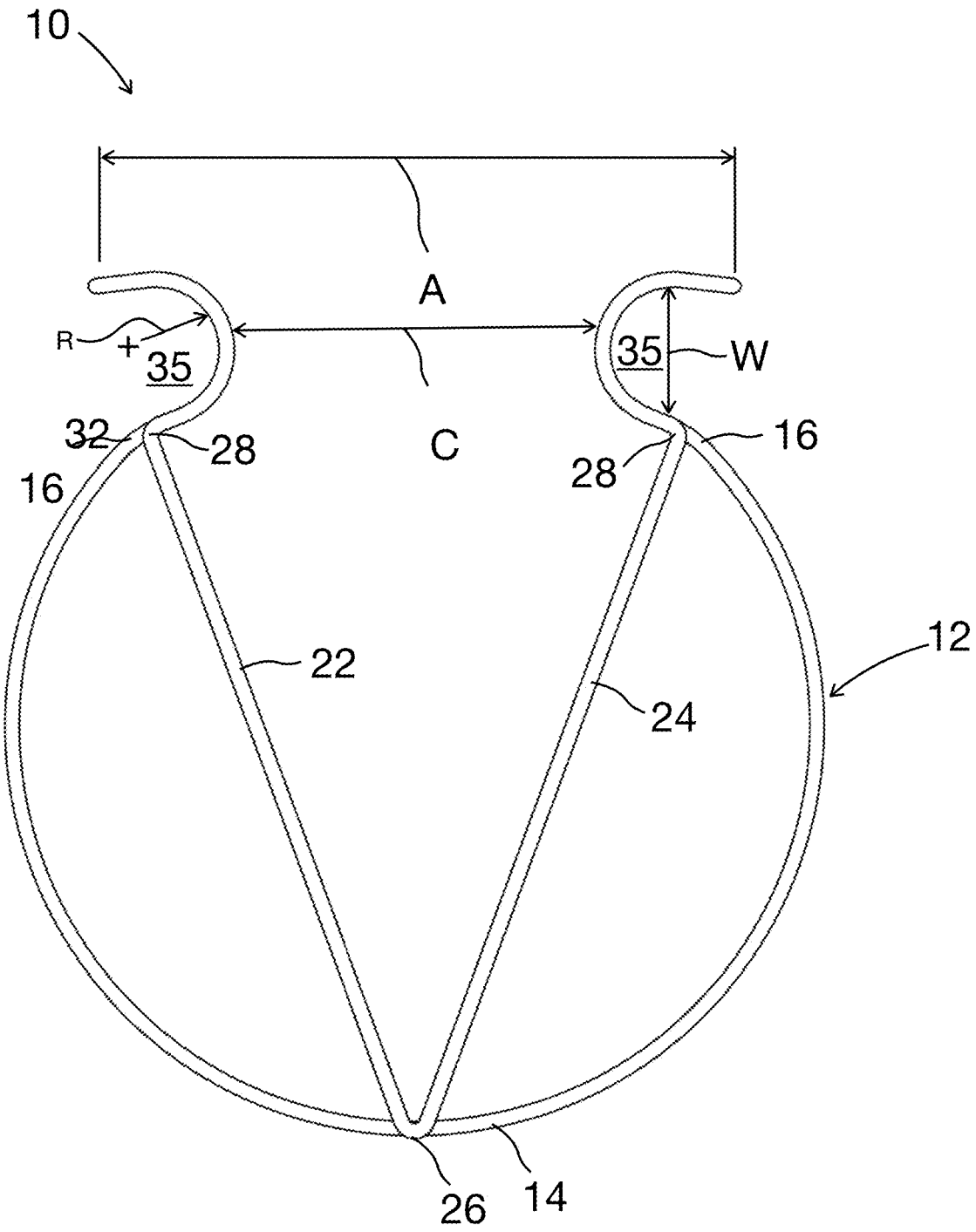
FIG. 8 is a bottom view of the display clip of FIG. 1.

As shown in FIGS. 7 and 8, the shapes and dimensions of the clamp channels 35 formed by the upper and lower clamps recesses 32 and 34 may be controlled in order to receive various sizes and shapes of railing spindles. Each clamp channel 35 may have a radius R and a width W, as labeled in FIG. 8. The clamp channel radius R may typically range from 0.1 to 1 inch, or from 0.2 to 0.8 inch, or from 0.3 to 0.5 inch. For smaller sized railing spindles, such as iron or aluminum spindles, R may be relatively small, while for larger sized railing spindles, such as wood or vinyl spindles, R may be relatively large. The clamp channel width W may typically range from 0.4 to 2 inches, or from 0.5 to 1.8 inches, or from 0.6 to 1.5 inches. For smaller sized railing spindles, W may be relatively small, while for larger sized railing spindles, W may be relatively large.

The upper hoop 12 may be provided in any suitable size. For example, when the upper hoop is circular in shape, it may have a typical diameter of from 4 to 12 inches, for example, from 5 to 10 inches, or from 6 to 9 inches. The height of the upper hoop 12 measured from the plane of the lower support base 20 may typically be from 2 to 6 or more inches, for example, from 3 to 5 inches.

The height or length of each of the rear connecting arms 30 may be the same as or similar to the height of the upper hoop 12. The opposed vertical arms may be located at a distance from each other of from 3 to 10 inches, and may be selected to be slightly larger than the distance between adjacent spindles of railings upon which the plant display mounting system is to be mounted. While the plant display mounting system is mounted on adjacent spindles in the figures, it is possible to secure the rear support arms on two spindles with at least one spindle in between.

Figure 9:
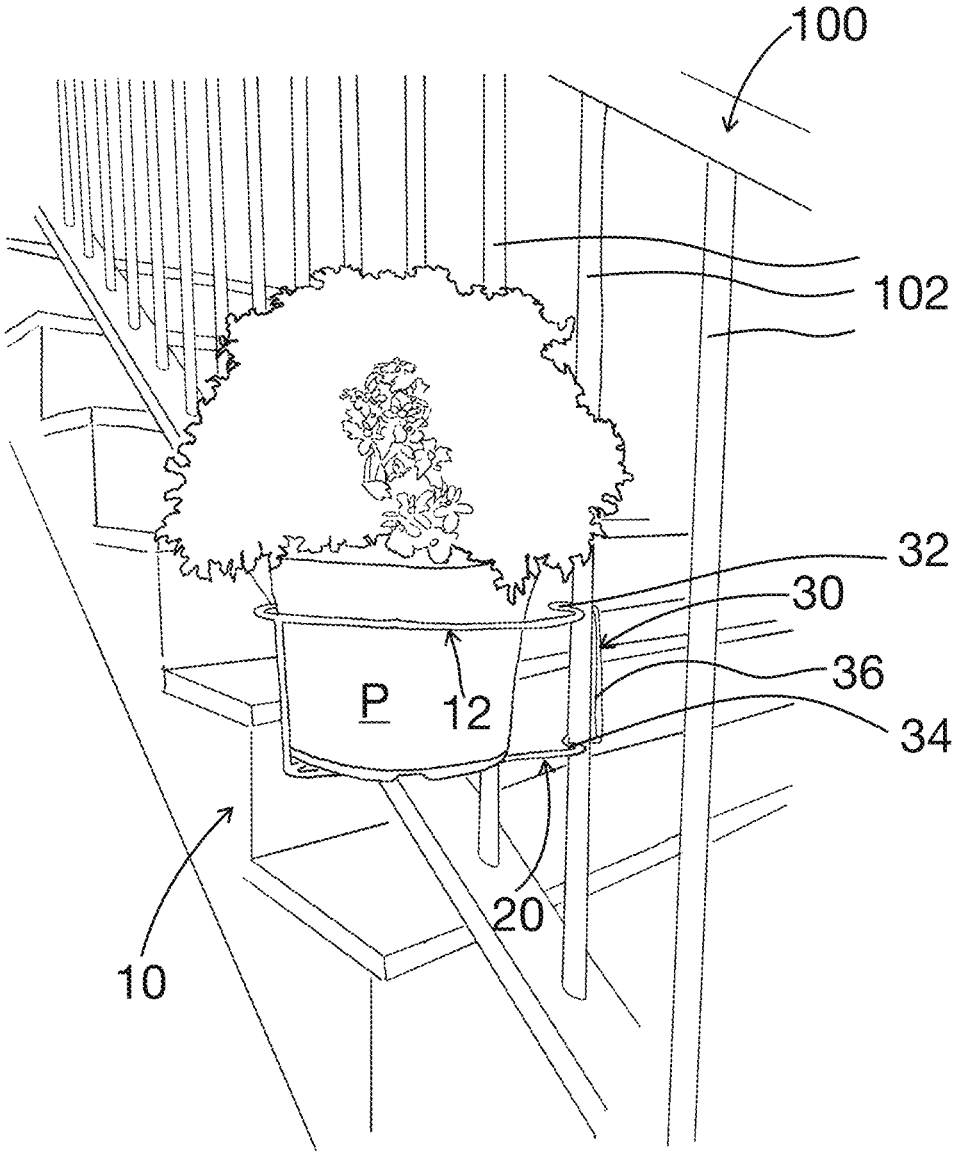
FIG. 9 is a partially schematic illustration of a display clip of the present invention mounted on railing spindles and supporting and displaying a potted plant.
Figure 10:
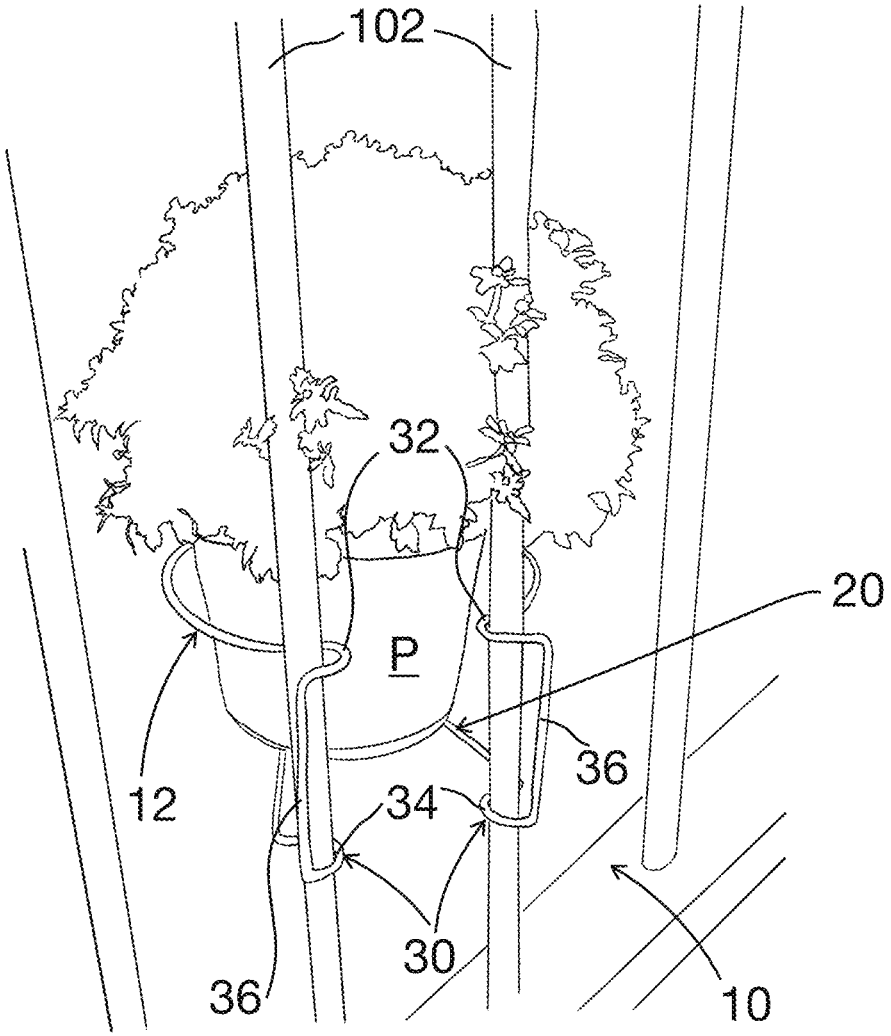
FIG. 10 is a partially schematic rear view of the display clip of FIG. 9.

FIGS. 9 and 10 illustrate a display clip 10 similar to that shown in FIGS. 1-8 installed on a railing 100 in accordance with an embodiment of the present invention. The railing 100 includes multiple vertical railing spindles 102. As shown in the front view of FIG. 9, the display clip 10 supports and displays a plant P with the display clip 10 and plant P extending forward from the railing. As shown in the rear view of FIG. 10, the opposing spring clamps 30 of the display clip 10 contact and partially surround adjacent railing spindles 102 of the railing 100. The upper clamp recesses 32, as well as the lower clamp recesses 34, contact and may press outwardly against the adjacent spindles 102 to retain the display clip 10 in a selected position along the height of the railing spindles 102. Each rear connecting arm 36 extending between it corresponding upper and lower clamp recesses 32 and 34 extends in a direction substantially parallel with an adjacent railing spindle 102.

Figure 11:
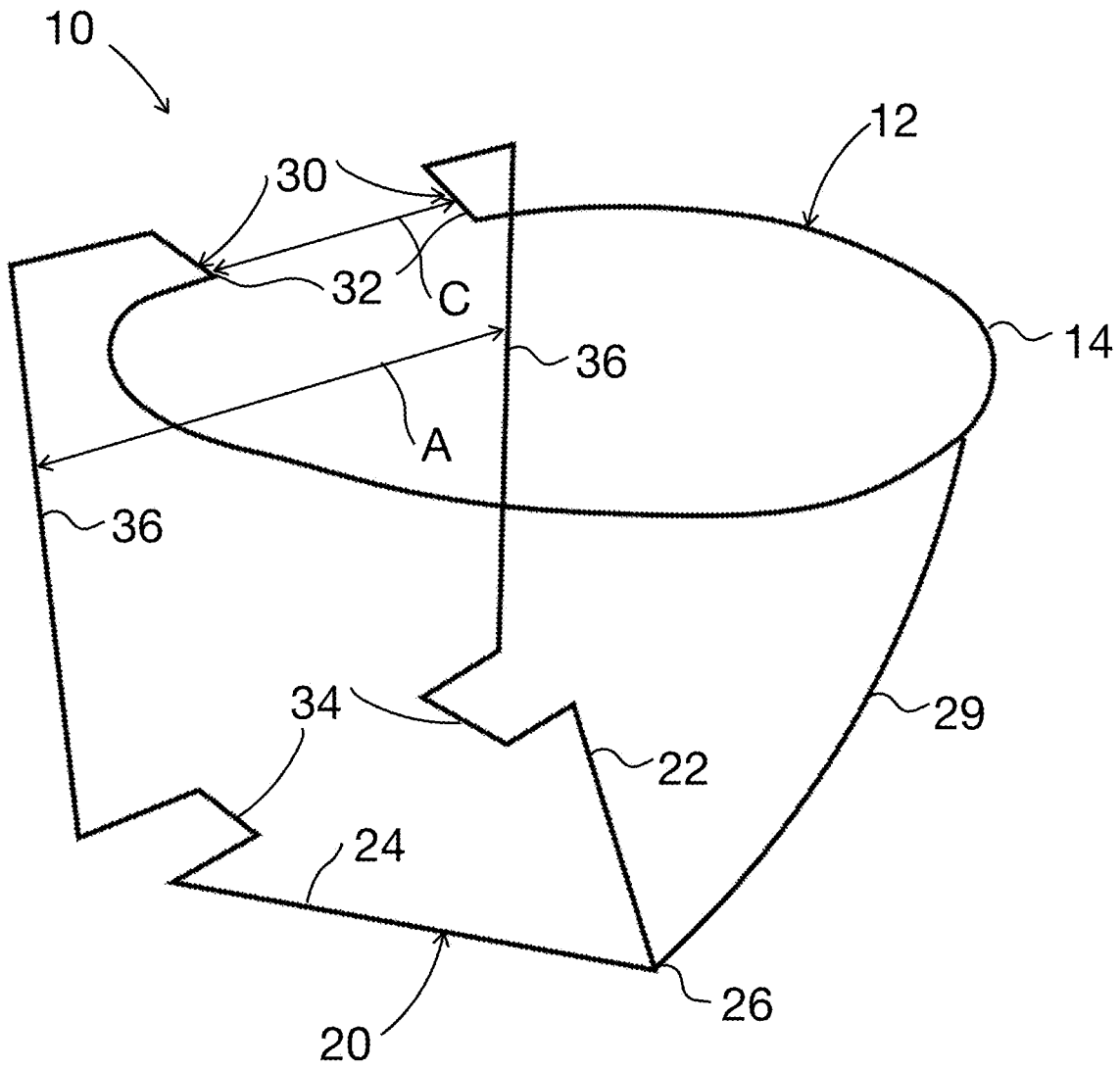
FIGS. 11-13 schematically illustrate steps for mounting a display clip on railing spindles in accordance with an embodiment of the present invention.
Figure 12:
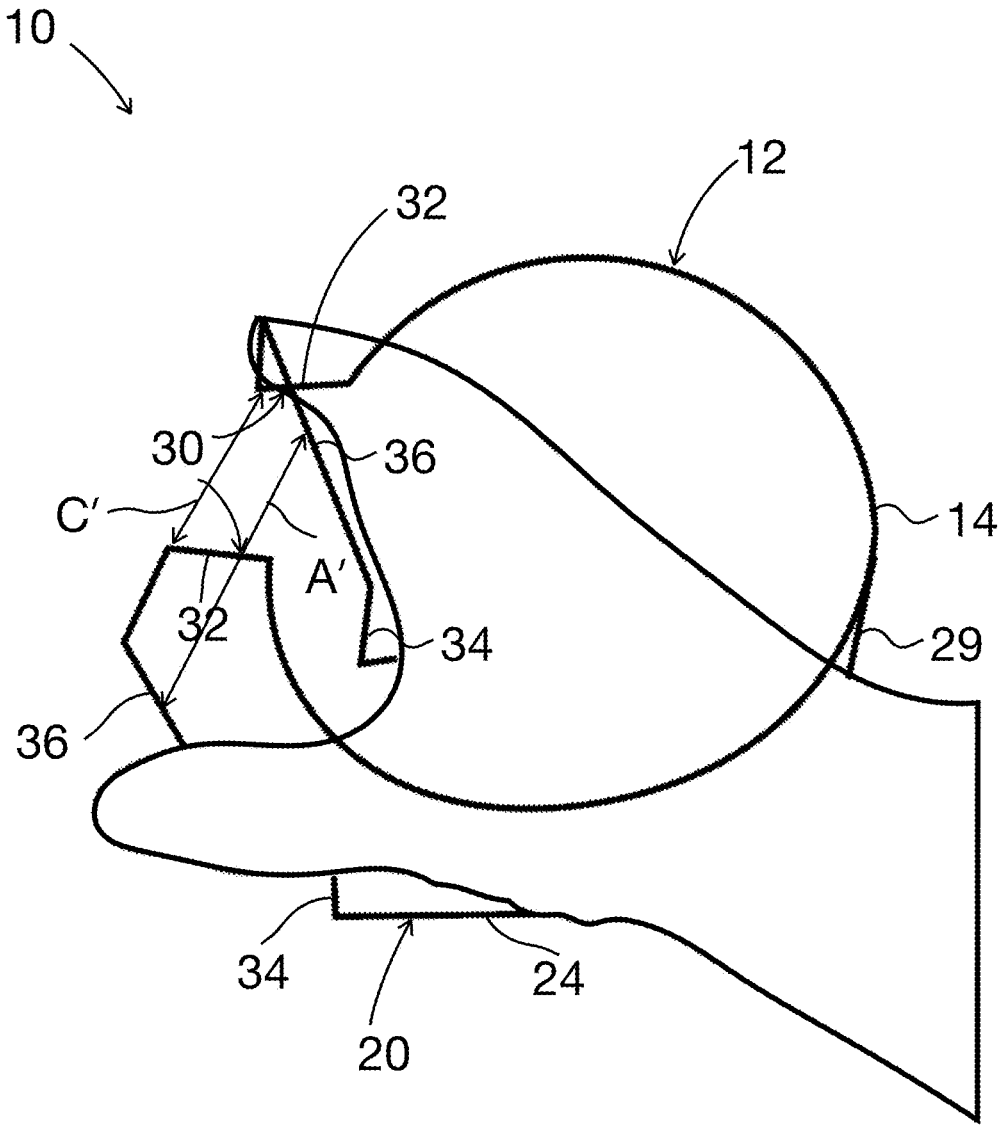
Figure 13:
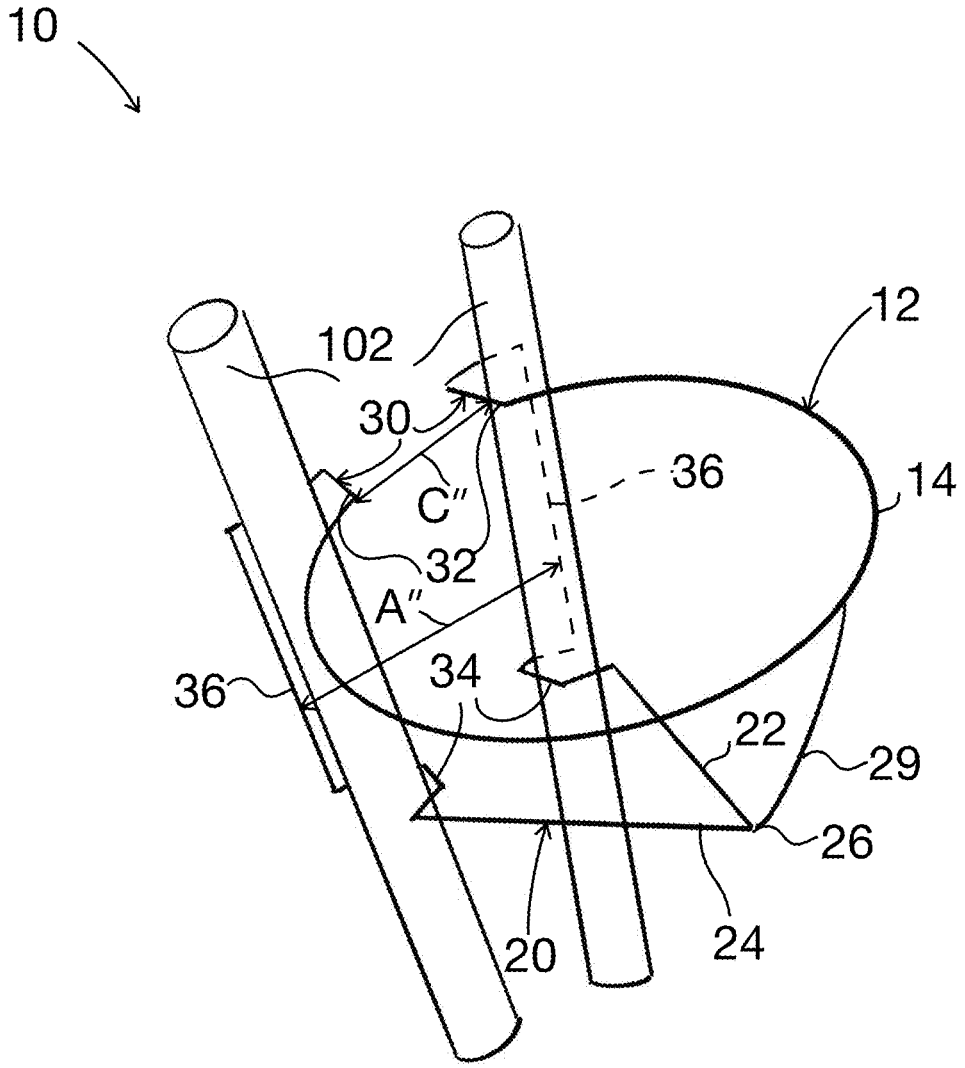

FIGS. 11-13 schematically illustrate installation steps for mounting a display clip on railing spindles 102. In FIG. 11, the display clip and opposing spring clamps 30 are in an initial position with the clamp separation distance C and rear arm separation distance A as illustrated in FIGS. 1, 2, 7 and 8 above. The initial clamp separation distance C may typically range from 2 to 12 inches, or from 3 to 11 inches, or from 4 to 10 inches. The initial rear arm separation distances A may typically range from 1 to 10 inches, or from 2 to 9 inches, or from 3 to 8 inches. In certain installations where railing spindles are relatively far apart, it may be necessary to increase the initial distances C and A, e.g., by pulling the opposing spring clamps apparat to slightly deform the upper hoop 12 and lower support base 20 to thereby widen the initial distances C and A before installation on the railing spindles.

In FIG. 12, the opposing spring clamps 30 including their corresponding upper clamp recesses 32, lower clamp recesses 34, and rear connecting arms 36 are forced or flexed together, i.e., by hand force, to an inwardly flexed position in which the flexed clamp separation distance C' is less than the initial clamp separation distance C, and the flexed rear arm separation distance A' is less than the initial ear arm separation distance A. The difference between the flexed clamp separation distance C' and the initial clamp separation distance C may be defined as a flexed clamp separation ratio C':C which may typically be less than 0.99:1, for example, less than 0.95:1, or less than 0.9:1. The clamp separation ratio C':C may typically range from 0.99:1 to 0.4:1, for example, from 0.5:1 to 0.95:1, or from 0.6:1 to 0.9:1. The flexed rear arm separation distance A' is less than the initial rear arm separation distance A such that the flexed rear arm separation distance to initial rear arm separation distance may be defined as a flexed rear arm separation ratio A':A of less than 0.99:1, for example, less than 0.95:1, or less than 0.9:1. The flexed rear arm separation ratio A':A may range from 0.99:1 to 0.4:1, for example, from 0.95:1 to 0.5:1, or from 0.6:1 to 0.9:1.

In FIG. 13, the opposing spring clamps 30 have been released from their inwardly flexed positions shown in FIG. 12 to an installed position on the railing spindles 102. Thus, the opposing spring clamps 30, including the upper and lower clamp recesses 32 and 34, and rear connecting arms 36, are in an installed position on the adjacent railing spindles 102. In the installed position, the opposing spring clamps 30 define an installed clamp separation distance C" and an installed rear arm separation distance A". The installed clamp separation distance C" may be greater than the flexed clamp separation distance C'. Similarly, the installed rear arm separation distance A" may be greater than the flexed rear arm separation distance A'. The installed clamp separation distance C" may be the same or less than the initial clamp separation distance C. Similarly, the installed rear arm separation distance A" may be the same or less than the initial rear arm separation distance A.

Figure 14:
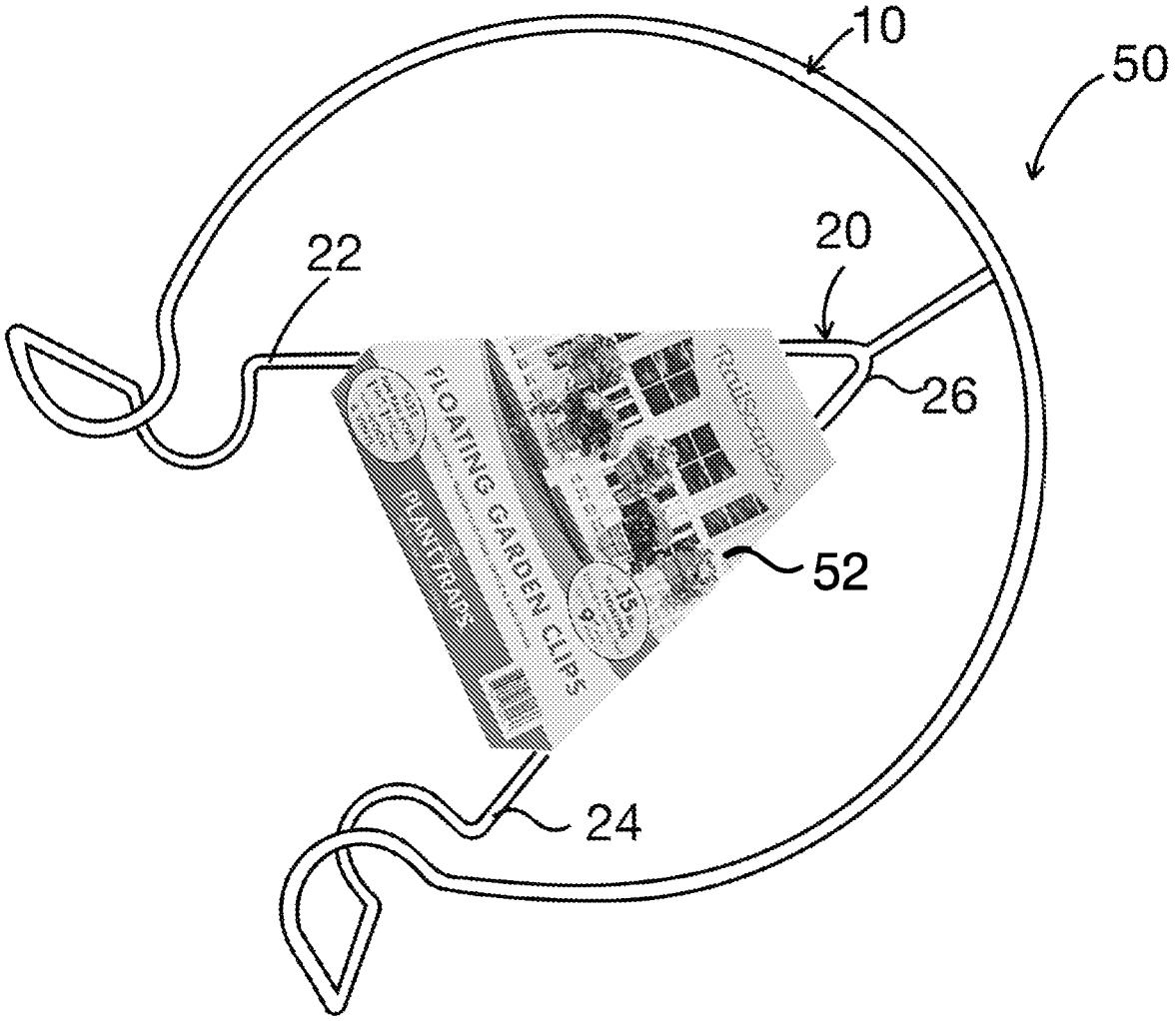
FIG. 14 is a top view of a display clip kit including a packaging pocket that may be used to contain railing bumpers in accordance with an embodiment of the present invention.
Figure 15:
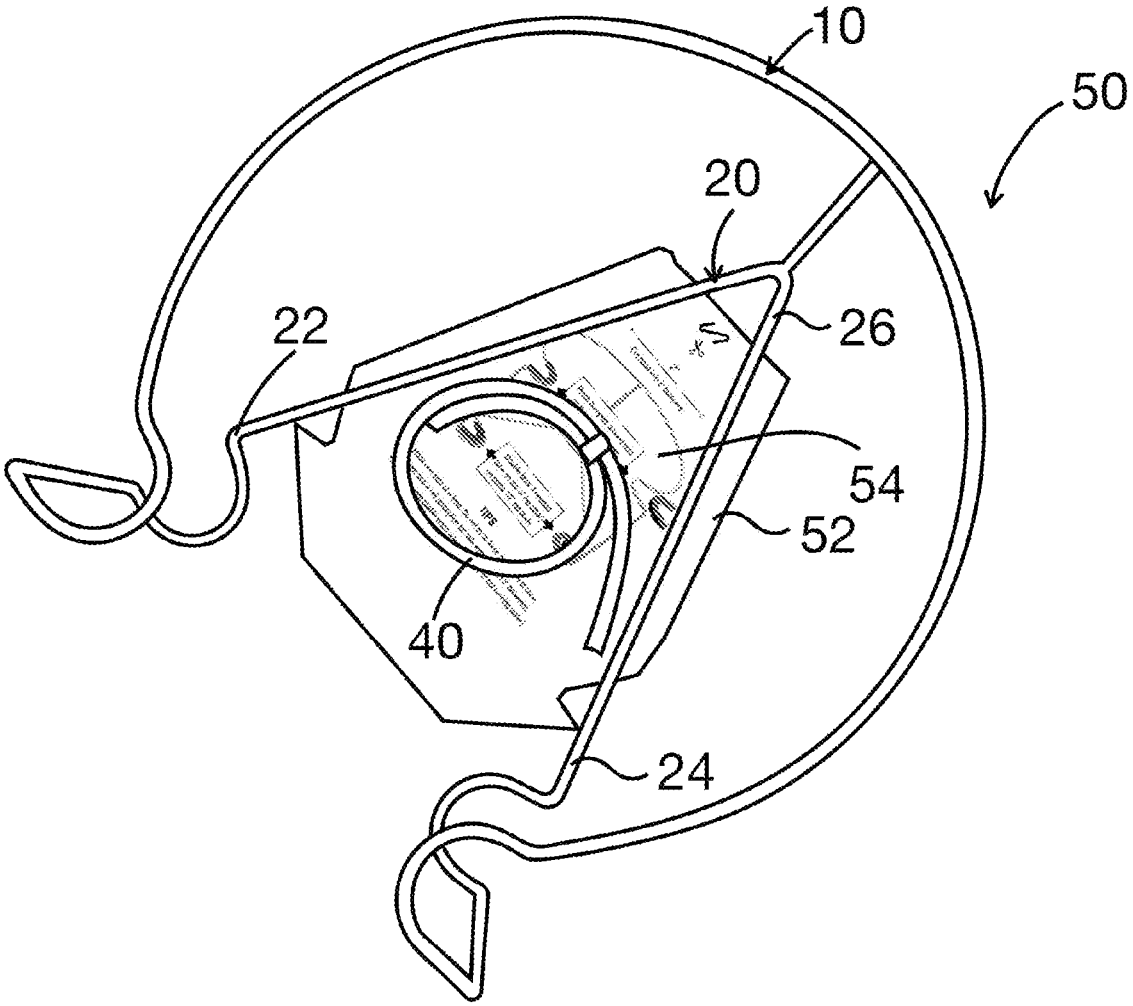
FIG. 15 is a top view of the display clip kit of FIG. 14 with the packaging pocket in an open position showing a length of bumper material that may be installed on the clip prior to mounting on a railing.

FIGS. 14 and 15 illustrate a display clip kit 50 in accordance with an embodiment of the present invention. The display clip kit 50 includes the display clip 10 and a packaging pocket 52. In the embodiment shown, the packaging pocket 52 is mounted on the first and second support rods 22 and 24 of the lower support base 20. However, the packaging pocket 52 may be mounted at various locations on lower support bases, as described above, or may be mounted at any other suitable location on the display clip 10. The packaging pocket 52 is shown in a closed position in FIG. 14, and in an open position in FIG. 15. As shown in FIG. 15, the packaging pocket 52 has an interior 54 that contains a length of bumper tube 40 that may be removed and cut to length as more fully described below.

Figure 16:
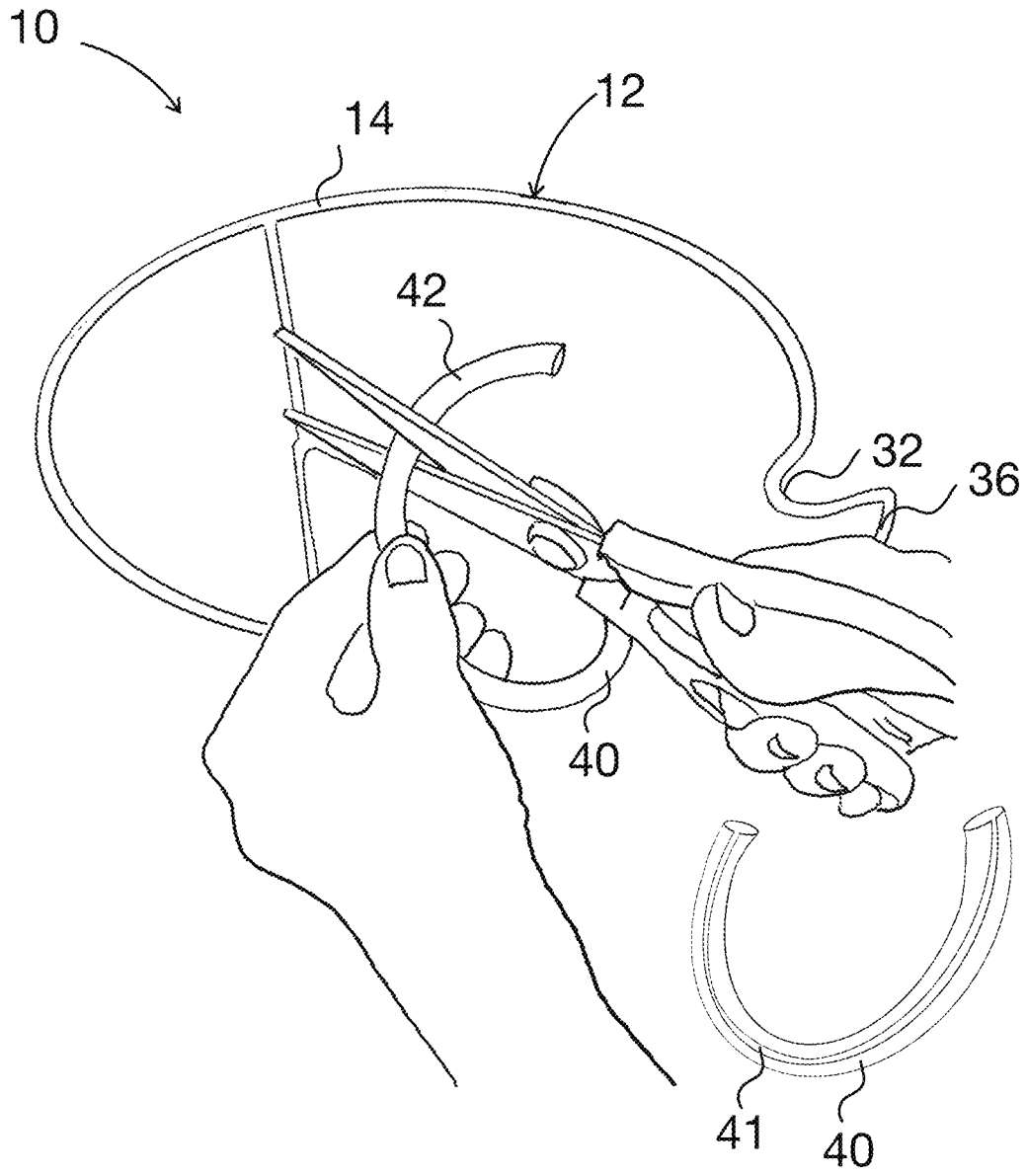
FIGS. 16-18 schematically illustrate steps of cutting and mounting bumpers on opposing spring clamps of a display clip in accordance with an embodiment of the present invention.
Figure 17:
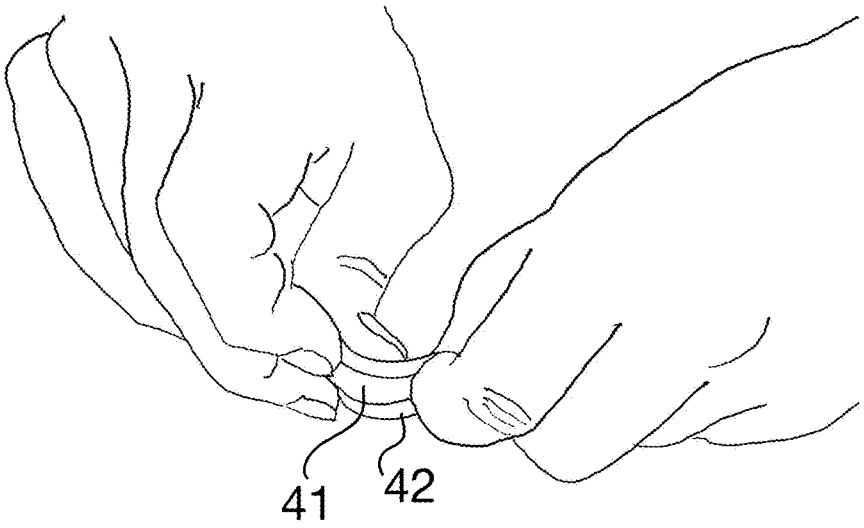
Figure 18:
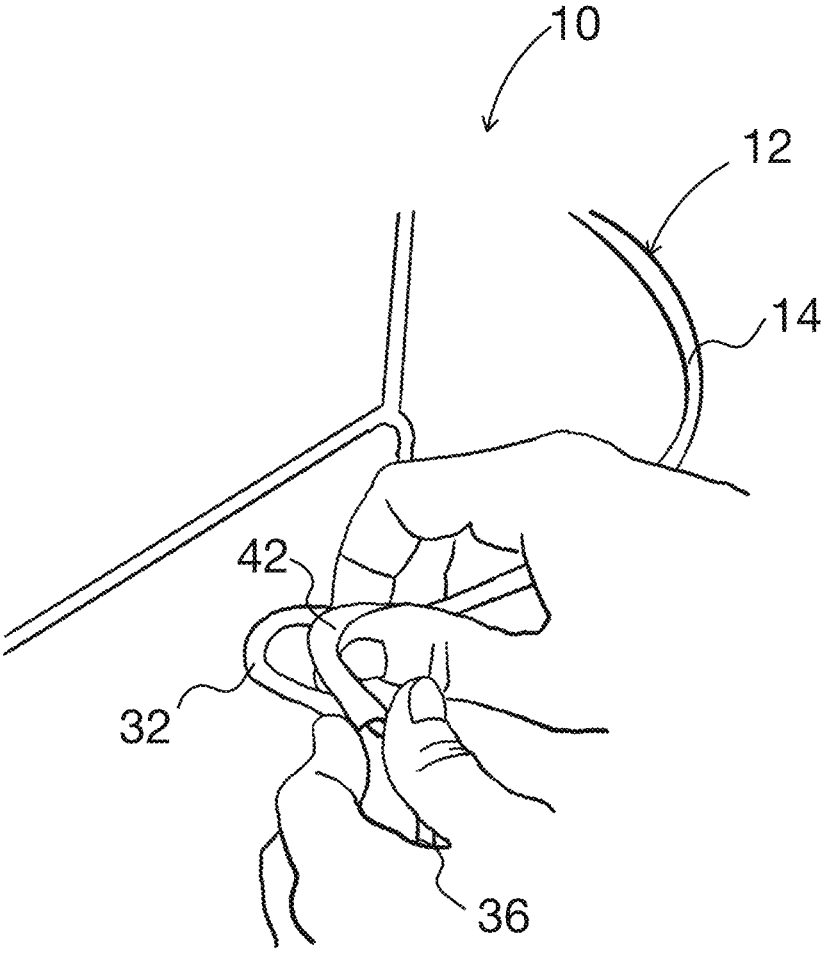
Figure 19:
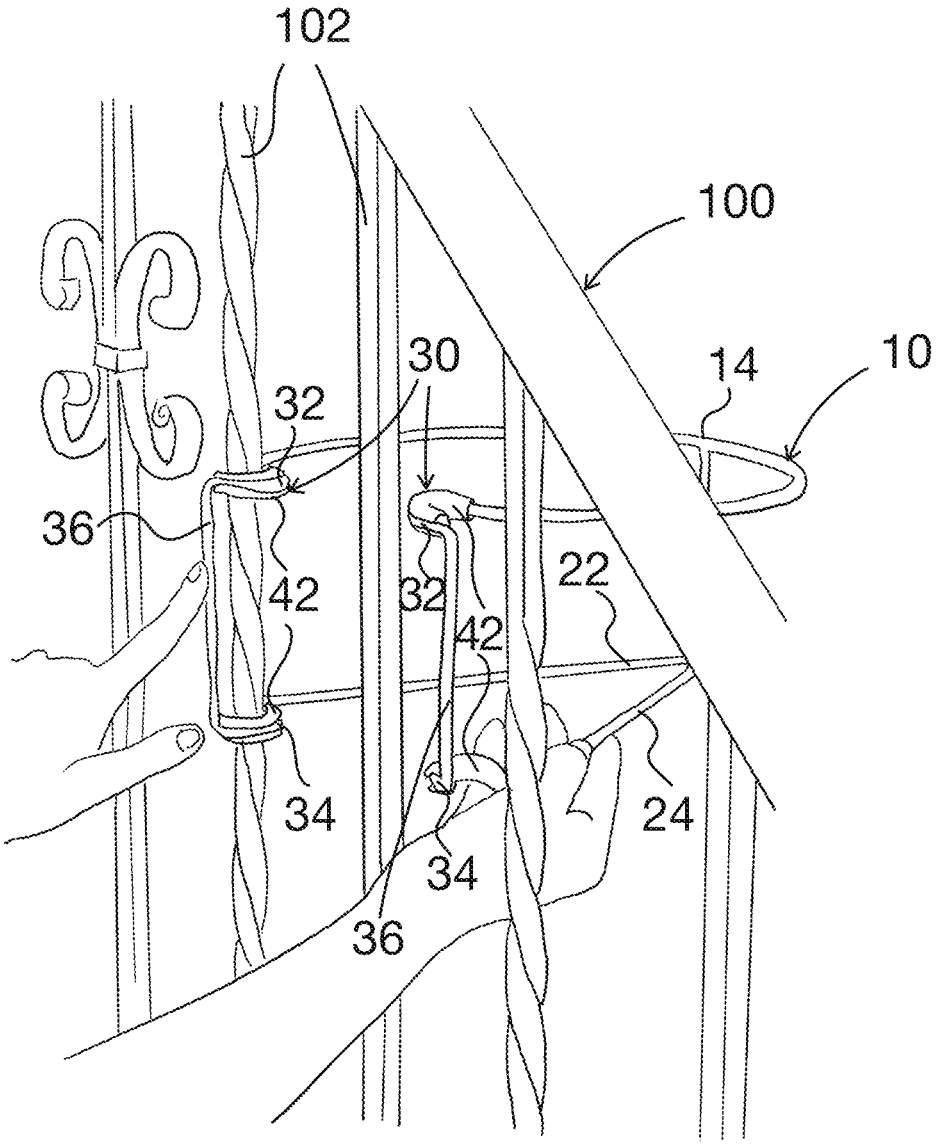
FIGS. 19 and 20 schematically illustrate steps of mounting the display clip and bumpers of FIGS. 16-18 on railing spindles.
Figure 20:
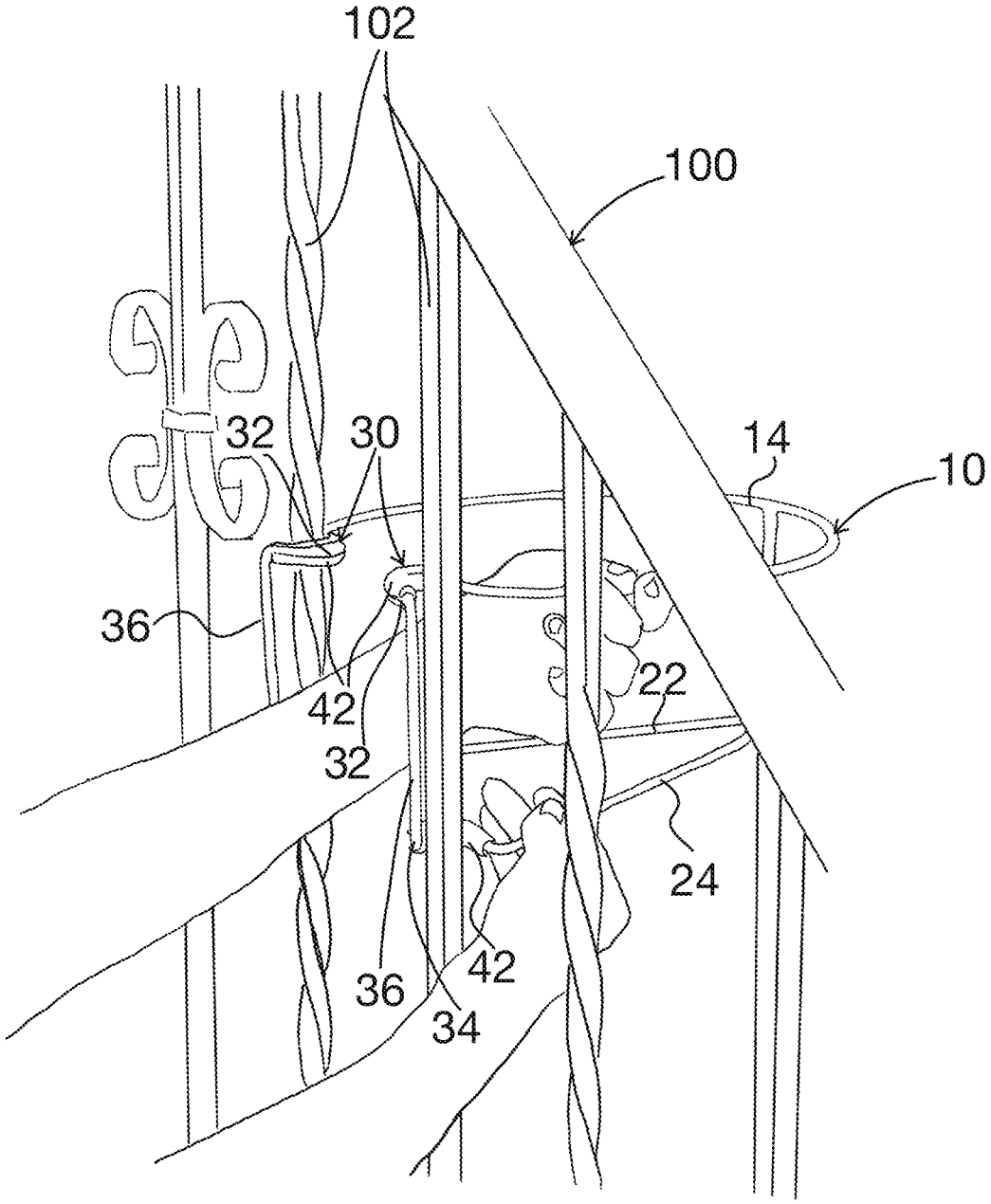

FIGS. 16-20 illustrate steps of cutting and mounting bumper sections 42 on the upper and lower clamp recesses 32 and 34 of the display clip 10, followed by installing the display clip 10 and bumper sections 42 on railing spindles 102. In FIG. 16, an initial length of bumper tube 40, such as shown in FIG. 15, is cut into bumper sections 42. FIG. 16 separately shows the bumper tube 40 prior to cutting into bumper sections. As shown, the bumper tube 40 may include a lengthwise slit 41 that facilitates installation of the bumper section 42 onto their respective upper clamp recesses 32 and lower clamp recesses 34. As shown in FIG. 17, a bumper section 42 may be bent to open its bumper slit 41. In FIG. 18, the bent bumper section 42 of FIG. 17 is pressed into an upper clamp recess 32 of the display clip 10. In FIG. 19, the display clip 10, with four bumper sections 42 installed, is positioned for mounting on adjacent railing spindles 102 of the railing 100. In the position shown in FIG. 19, the opposing spring clamps 30 are in their initial positions with the clamp separation distance C and rear arm separation distance A of FIGS. 1, 2, 7 and 8. In FIG. 20, the opposing spring clamps 30, which have been previously flexed to a position as shown in FIG. 12, are subsequently expanded to the installed position shown to engage the opposing railing spindles 102.

Figure 21:
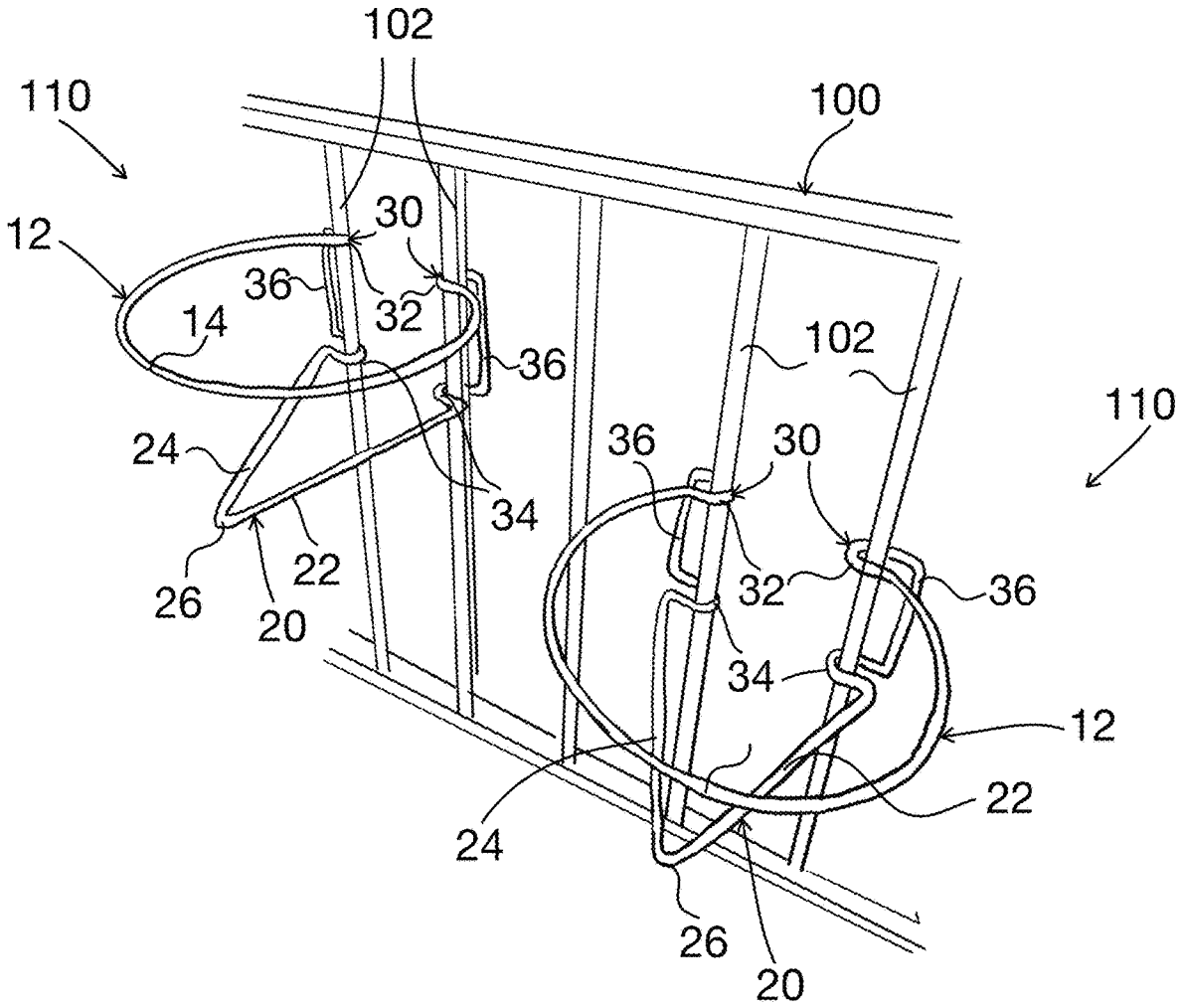
FIG. 21 is a partially schematic isometric view of display clips in accordance with an embodiment of the present invention mounted on railing spindles.
Figure 22:
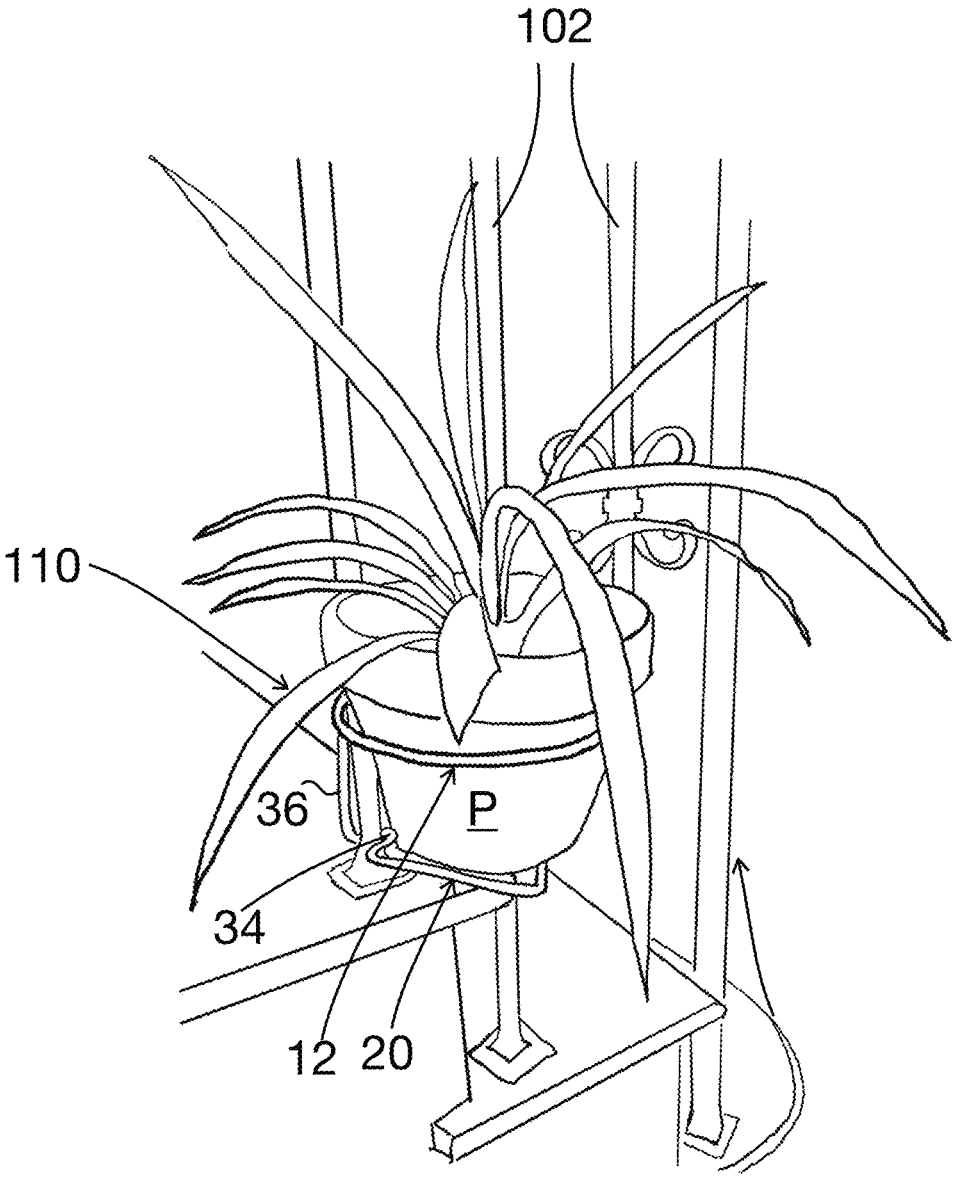
FIG. 22 is a partially isometric view of a display clip of FIG. 21 mounted on railing spindles and supporting and displaying a potted plant.

FIGS. 21 and 22 illustrate display clips 110 in accordance with another embodiment of the present invention. Each display clip 110 has similar structural features as the embodiment shown in FIGS. 1-8, except the front connecting arm 29 is not present. In FIG. 21, two of the display clips 110 are mounted on different pairs of railing spindles 102. In FIG. 22, a single display clip 110 is mounted on adjacent railing spindles 102.

The display clips may be made from a single or multiple pieces of rod or wire. Any suitable cross-sectional shape and gauge or thickness of rod may be used, for example, diameters of from 0.1 to 0.3 or 0.4 inch, or from 0.12 to 0.25 inch, or from 0.15 to 0.2 inch. The rod may be made of any suitable material such as metal, e.g., steel, aluminum or the like. For example, the rod may comprise steel that may optionally be painted, powder coated or dip coated. Alternatively, the rod may be made of relatively rigid plastic, in which case the shape and thickness of the rod may be adjusted to provide sufficient support and flexibility for the display clips. The rod may be provided in any desired color.

In one embodiment, plants or other articles may be displayed up and down the spindles at any desired height. In another embodiment, plants or other articles may be displayed on the base of railings by using the spindles and bottom rail or ground for support. This allows the user an unencumbered top rail and a top-down view of a container garden as opposed to the face of a window box (resting on top of a railing) or the bottom of a hanging basket. The rear opposing spring clamps 30 may be squeezed together to be slipped between two spindles and then expand when released to partly wrap around the spindles. The contact with the spindles stabilizes the display clips 10 and 110 and prohibits more than a small movement side to side or front to back. Some spindles may require the additional support of a commercially available zip tie, washer, clip or the like around the spindles under the device. In one embodiment, the structure may slide down the spindles to meet the ground, floor or bottom rail. In this embodiment, the ground, floor or bottom rail may provide support for the weight of the plant and planter.

Installed on the exterior, the display clips may provide curb appeal and create more room for living on the interior of outdoor living spaces. Installed on the interior, the display clips may secure plants or other articles to railing spindles so they are not dislodged, e.g., by wind conditions. Installed indoors on railings or stairs, the display clips may provide a decorative element for house plants and seasonal decorations.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application in accordance with its customary meaning to include the specified elements or method steps, where applicable, and to also include any unspecified elements or method steps that do not materially affect the basic or novel characteristics of the invention, while excluding unspecified elements or method steps that would materially affect the basic or novel characteristics of the invention.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A display clip for mounting on railings comprising:
an upper hoop;
a lower support base; and
opposing spring clamps extending between the upper hoop and lower support base, the opposing spring clamps comprising:
a first upper clamp recess adjacent the upper hoop, a first lower clamp recess adjacent the lower support base, and a first rear connecting arm extending between the first upper clamp recess and the first lower clamp recess, wherein the first upper clamp recess and the first lower clamp recess are structured and arranged to engage a first railing spindle when the display clip is mounted on a railing; and
a second upper clamp recess adjacent the upper hoop, a second lower clamp recess adjacent the lower support base, and a second rear connecting arm extending between the second upper clamp recess and the second lower clamp recess, wherein the second upper clamp recess and the second lower clamp recess are structured and arranged to engage a second railing spindle when the display clip is mounted on the railing.

2. The display clip of claim 1, wherein the upper hoop, the first upper clamp recess and the second upper clamp recess lie in an upper plane.

3. The display clip of claim 2, wherein the lower support base, the first lower clamp recess and the second lower clamp recess lie in a lower plane below the upper plane.

4. The display clip of claim 1, wherein the lower support base, the first lower clamp recess and the second lower clamp recess lie in a lower plane.

5. The display clip of claim 1, wherein the upper hoop comprises a circular portion.

6. The display clip of claim 1, wherein the upper hoop is interrupted in a region between the first and second upper clamp recesses.

7. The display clip of claim 1, wherein the upper hoop comprises a front portion, a first rear transition portion extending to the first upper clamp recess, and a second rear transition portion extending to the second upper clamp recess.

8. The display clip of claim 1, wherein the lower support base comprises first and second support rods.

9. The display clip of claim 8, wherein at least one of the first and second support rods comprise a straight portion.

10. The display clip of claim 8, wherein the first and second support rods comprise straight portions connected together by a transition nose.

11. The display clip of claim 1, wherein the lower support base comprises a circular portion.

12. The display clip of claim 1, wherein the lower support base is interrupted in a region between the first and second lower clamp recesses.

13. The display clip of claim 1, wherein the lower support base comprises a first rear transition portion extending to the first lower clamp recess, and a second rear transition portion extending to the second lower clamp recess.

14. The display clip of claim 1, further comprising a front connecting arm extending between a front portion of the upper hoop and the lower support base.

15. The display clip of claim 14, wherein the upper hoop lies in an upper plane, the lower support base lies in a lower plane parallel with the upper plane, and the front connecting arm is normal to the upper and lower planes.

16. The display clip of claim 1, wherein each of the first and second upper clamp recesses comprise a curved portion.

17. The display clip of claim 1, wherein each of the first and second upper clamp recesses comprise intersecting straight portions.

18. The display clip of claim 1, wherein each of the first and second lower clamp recesses comprise a curved portion.

19. The display clip of claim 1, wherein each of the first and second lower clamp recesses comprise intersecting straight portions.

20. The display clip of claim 1, wherein the first upper clamp recess and the first lower clamp recess define a first clamp channel structured and arranged to receive at least a portion of the first railing spindle therein, and the second upper clamp recess and the second lower clamp recess define a second clamp channel structured and arranged to receive at least a portion of the second railing spindle therein.

21. The display clip of claim 20, wherein each of the first and second clamp channels define a clamp channel radius R of from 0.2 to 0.8 inch, and a clamp channel width W of from 0.5 to 2 inches.

22. The display clip of claim 20, wherein the first and second clamp channels comprise recess openings facing away from each other.

23. The display clip of claim 1, further comprising at least one bumper tube structured and arranged for mounting on at least one of the first upper clamp recess, the second upper clamp recess, the first lower clamp recess and the second lower clamp recess.

24. The display clip of claim 23, wherein the at least one bumper tube comprises a length of tube that may be cut into separate bumper tube sections for mounting on the first upper clamp recess, the second upper clamp recess, the first lower clamp recess and the second lower clamp recess.

25. The display clip of claim 23, wherein the bumper tube comprises a slit sidewall extending along a length of the bumper tube and is made of resilient foam or rubber.

26. A display clip and mounting bumper kit comprising:

a display clip comprising:

an upper hoop;

a lower support base; and opposing spring clamps extending between the upper hoop and lower support base, the opposing spring clamps comprising:

a first upper clamp recess adjacent the upper hoop, a first lower clamp recess adjacent the lower support base, and a first rear connecting arm extending between the first upper clamp recess and the first lower clamp recess, wherein the first upper clamp recess and the first lower clamp recess are structured and arranged to engage a first railing spindle when the display clip is mounted on a railing; and a second upper clamp recess adjacent the upper hoop, a second lower clamp recess adjacent the lower support base, and a second rear connecting arm extending between the second upper clamp recess and the second lower clamp recess, wherein the second upper clamp recess and the second lower clamp recess are structured and arranged to engage a second railing spindle when the display clip is mounted on the railing; and at least one bumper tube structured and arranged for mounting on at least one of the first upper clamp recess, the second upper clamp recess, the first lower clamp recess and the second lower clamp recess.

27. The display clip and mounting bumper kit of claim 26, wherein the at least one bumper tube comprises a length of tube that may be cut into separate bumper tube sections for mounting on the first upper clamp recess, the second upper clamp recess, the first lower clamp recess and the second lower clamp recess.

28. The display clip and mounting bumper kit of claim 27, further comprising a packaging pocket removably attached to the display clip containing the at least one bumper tube.

29. A method of mounting a display clip of claim 1 on railing spindles, the method comprising:

flexing the opposing clamps of the display clip of claim 1 to a flexed position allowing the opposing clamps to pass between adjacent railing spindles; and allowing the opposing clamps to spring back against the railing spindles to thereby secure the display clip on the railing spindles.

30. The method of claim 29, further comprising mounting at least one resilient bumper tube section on at least one of the first upper clamp recess, the second upper clamp recess, the first lower clamp recess and the second lower clamp recess prior to the step of flexing the opposing clamps.

* * * * *